US006585355B2

(12) United States Patent
Lee et al.

(10) Patent No.: US 6,585,355 B2
(45) Date of Patent: Jul. 1, 2003

(54) INK-JET PRINTHEAD HAVING HEMISPHERICAL INK CHAMBER AND METHOD FOR MANUFACTURING THE SAME

(75) Inventors: Sang-wook Lee, Seongnam (KR); Hyeon-cheol Kim, Seoul (KR); Yong-soo Oh, Seongnam (KR)

(73) Assignee: Samsung Electronics Co., Ltd., Kyungki-do (KR)

( * ) Notice: Subject to any disclaimer, the term of this patent is extended or adjusted under 35 U.S.C. 154(b) by 0 days.

(21) Appl. No.: 10/255,761

(22) Filed: Sep. 27, 2002

(65) Prior Publication Data

US 2003/0035029 A1 Feb. 20, 2003

Related U.S. Application Data

(62) Division of application No. 10/036,403, filed on Jan. 7, 2002, now Pat. No. 6,478,408.

(30) Foreign Application Priority Data

Jan. 8, 2001 (KR) ..... 2001-918

(51) Int. Cl.[7] ..... B41J 2/05; H05B 3/00

(52) U.S. Cl. ..... 347/56; 29/611

(58) Field of Search ..... 347/44, 47, 54, 347/56, 63, 65, 67, 92, 94; 29/890.1, 611, 610.1

(56) References Cited

U.S. PATENT DOCUMENTS 4,339,762 A 7/1982 Shirato et al. ..... 347/62
4,847,630 A 7/1989 Bhaskar et al. ..... 347/63
4,882,595 A 11/1989 Trueba et al. ..... 347/65
5,760,804 A 6/1998 Heinzl et al. ..... 347/56
5,841,452 A * 11/1998 Silverbrook ..... 29/890.1
5,850,241 A 12/1998 Silverbrook ..... 347/54

FOREIGN PATENT DOCUMENTS

EP 0 317 171 A2 A3 5/1989 ..... B41J/3/04

OTHER PUBLICATIONS

Tseng, et al., "A Novel Microinjector with Virtual Chamber Neck", IEEE MEMS , pp. 57–62, (1998).

* cited by examiner

*Primary Examiner*—Raquel Yvette Gordon
*Assistant Examiner*—Juanita Stephens
(74) *Attorney, Agent, or Firm*—Lee & Sterba, P.C.

(57) ABSTRACT

An ink-jet printhead having a hemispherical ink chamber and a method for manufacturing the same, wherein the ink-jet printhead includes a substrate, in which a manifold for supplying ink, an ink chamber having a substantially hemispherical shape, and an ink channel for supplying ink from the manifold to the ink chamber are integrally formed; a nozzle plate having a multi-layered structure, in which a first insulating layer, a thermally conductive layer formed of a thermally conductive material, and a second insulating layer are sequentially stacked, and having a nozzle, formed at a location corresponding to the center of the ink chamber; a nozzle guide having a multi-layered structure and extending from the edge of the nozzle to the inside of the ink chamber; a heater formed on the nozzle plate to surround the nozzle, and an electrode formed on the nozzle plate to be electrically connected to the heater.

5 Claims, 13 Drawing Sheets

INK-JET PRINTHEAD HAVING HEMISPHERICAL INK CHAMBER AND METHOD FOR MANUFACTURING THE SAME

This application is a Division of application Ser. No. 10/036,403, filed Jan. 7, 2002 now U.S. Pat. No. 6,478,408.

BACKGROUND OF THE INVENTION

1. Field of the Invention

The present invention relates to a bubble-jet type ink-jet printhead.

More particularly, the present invention relates to an ink-jet printhead having a hemispherical ink chamber and a method for manufacturing the same.

2. Description of the Related Art

Ink-jet printheads are devices for printing a predetermined image by ejecting small droplets of printing ink at desired positions on a recording sheet. Ink ejection mechanisms of an ink-jet printer are generally categorized into two different types: an electro-thermal transducer type (bubble-jet type), in which a heat source is employed to form a bubble in ink causing an ink droplet to be ejected, and an electromechanical transducer type, in which a piezoelectric crystal bends to change the volume of ink causing ink droplets to be expelled.

FIGS. 1A and 1B are diagrams illustrating a conventional bubble-jet type ink-jet printhead. Specifically, FIG. 1A is a perspective view illustrating the structure of an ink ejector as disclosed in U.S. Pat. No. 4,882,595. FIG. 1B illustrates a cross-sectional view of the ejection of an ink droplet in the conventional ink ejector.

The conventional bubble-jet type ink-jet printhead shown in FIGS. 1A and 1B includes a substrate 10, a barrier wall 12 formed on the substrate 10 to form an ink chamber 13 for containing ink 19, a heater 14 installed in the ink chamber 13, and a nozzle plate 11 having a nozzle 16 for ejecting an ink droplet 19'. The ink 19 is supplied to the ink chamber 13 through an ink channel 15, and the ink 19 fills the nozzle 16 connected to the ink chamber 13 by capillary action. In a printhead of the current configuration, if current is applied to the heater 14 to generate heat, a bubble 18 is generated in the ink 19 filling the ink chamber 13 and continues to expand. Due to the expansion of the bubble 18, pressure is applied to the ink 19 within the ink chamber 13, and thus the ink droplet 19' is ejected through the nozzle 16. Next, ink 19 is supplied through the ink channel 15 to refill the ink chamber 13.

There are multiple factors and parameters to consider in making an ink-jet printhead having a bubble-jet type ink ejector. First, it should be simple to manufacture, have a low manufacturing cost, and be capable of being mass-produced. Second, in order to produce high quality color images, the formation of minute, undesirable satellite ink droplets that usually trail an ejected main ink droplet must be avoided. Third, when ink is ejected from one nozzle or when ink refills an ink chamber after ink ejection, cross-talk with adjacent nozzles, from which no ink is ejected, must be avoided. To this end, a back flow of ink in a direction opposite to the direction ink is ejected from a nozzle must be prevented during ink ejection. Fourth, for high-speed printing, a cycle beginning with ink ejection and ending with ink refill in the ink channel must be carried out in as short a period of time as possible. In other words, an ink-jet printhead must have a high driving frequency.

The above requirements, however, tend to conflict with one another. Furthermore, the performance of an ink-jet printhead is closely associated with and affected by the structure and design of an ink chamber, an ink channel, and a heater, as well as by the type of formation and expansion of bubbles, and the relative size of each component.

In an effort to overcome problems related to the above requirements, various ink-jet printheads having different structures have already been suggested in U.S. Pat. Nos. 4,882,595; 4,339,762; 5,760,804; 4,847,630; 5,850,241; European Patent No. 317,171; and Fan-gang Tseng, Chang-jin Kim, and Chih-ming Ho, "A Novel Microinjector with Virtual Chamber," IEEE MEMS, pp. 57–62, 1998. However, ink-jet printheads proposed in the above-mentioned patents and publication may satisfy some of the aforementioned requirements but do not completely provide an improved ink-jet printing approach.

SUMMARY OF THE INVENTION

In an effort to solve the above-described problems, it is a feature of an embodiment of the present invention to provide an ink-jet printhead having a hemispherical chamber, which is capable of effectively cooling heat generated by a heater, and a method for manufacturing the same.

Accordingly, an embodiment of the present invention provides a method for manufacturing an ink-jet printhead having a hemispherical chamber. The method includes forming a ring-shaped groove for forming a nozzle guide at the surface of a substrate, forming a nozzle plate and a nozzle guide having a multi-layered structure and including a thermally conductive layer formed at the surface of the substrate, forming a heater on the nozzle plate, forming a manifold for supplying ink by etching the substrate, forming an electrode on the nozzle plate to be electrically connected to the heater, forming a nozzle having almost the same diameter as the nozzle guide by etching the nozzle plate inside the heater, forming an ink chamber in a substantially hemispherical shape by etching the substrate exposed through the nozzle, and forming an ink channel for supplying ink from the manifold to the ink chamber by etching the substrate.

Here, forming the nozzle plate and the nozzle guide preferably includes forming a first insulating layer at the surface of the substrate and the inner surfaces of the ring-shaped groove, forming the thermally conductive layer by depositing polysilicon on the first insulating layer and simultaneously forming the nozzle guide by filling the polysilicon in the ring-shaped groove, and forming a second insulating layer on the thermally conductive layer.

According to the present invention, since an ink chamber, an ink channel, and a manifold for supplying ink are integrally formed in a substrate into one body and a nozzle plate, a heater, and a nozzle guide are also integrally formed on the substrate into one body, the manufacture of an ink-jet printhead having a structure according to the present invention is simplified, and thus mass production of the printhead is facilitated.

BRIEF DESCRIPTION OF THE DRAWINGS

The above features and advantages of the present invention will become readily apparent to those of ordinary skill in the art by describing in detail preferred embodiments thereof with reference to the attached drawings in which.

DETAILED DESCRIPTION OF THE INVENTION

Figure 1A:
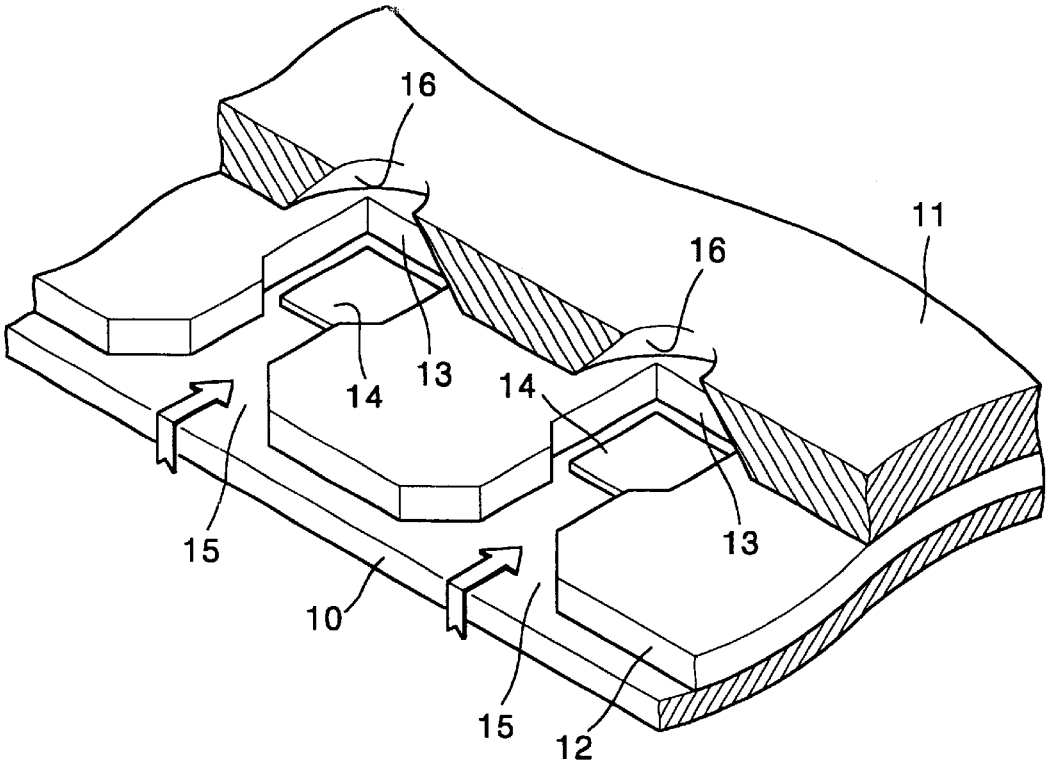
FIG. 1A (PRIOR ART)
FIGS. 1A and 1B illustrate a perspective view and a cross-sectional view, respectively, of a conventional bubble-jet type ink-jet printhead.
Figure 1B:
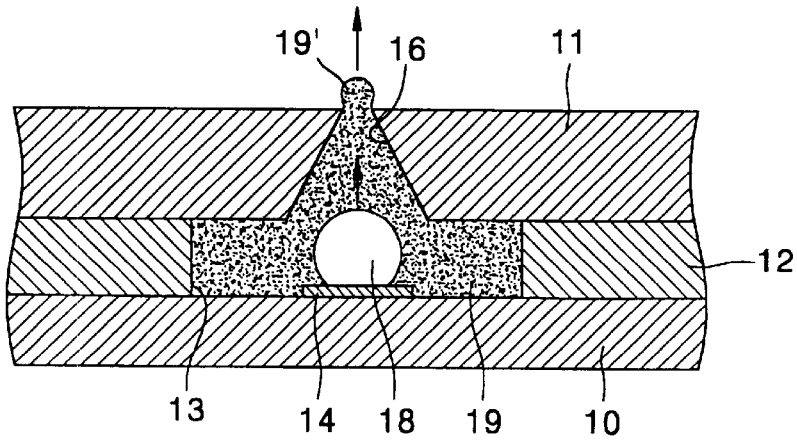
FIG. 1B (PRIOR ART)

Korean Patent Application No. 2001-918, filed Jan. 8, 2001, entitled: "Ink-jet Printhead Having Hemispherical Ink Chamber and Method for Manufacturing the Same," is incorporated by reference herein in its entirety.

The present invention will now be described more fully with reference to the accompanying drawings, in which preferred embodiments of the invention are shown. This invention may, however, be embodied in many different forms and should not be construed as being limited to the embodiments set forth herein. Rather, these embodiments are provided so that this disclosure will be thorough and complete, and will fully convey the concept of the present invention to those of ordinary skill in the art. In the drawings, the shape and thickness of an element may be exaggerated for clarity, and like reference numerals appearing in different drawings represent like elements. Further, it will be understood that when a layer is referred to as being "on" another layer or substrate, it may be directly on the other layer or substrate, or intervening layers may also be present.

Figure 2:
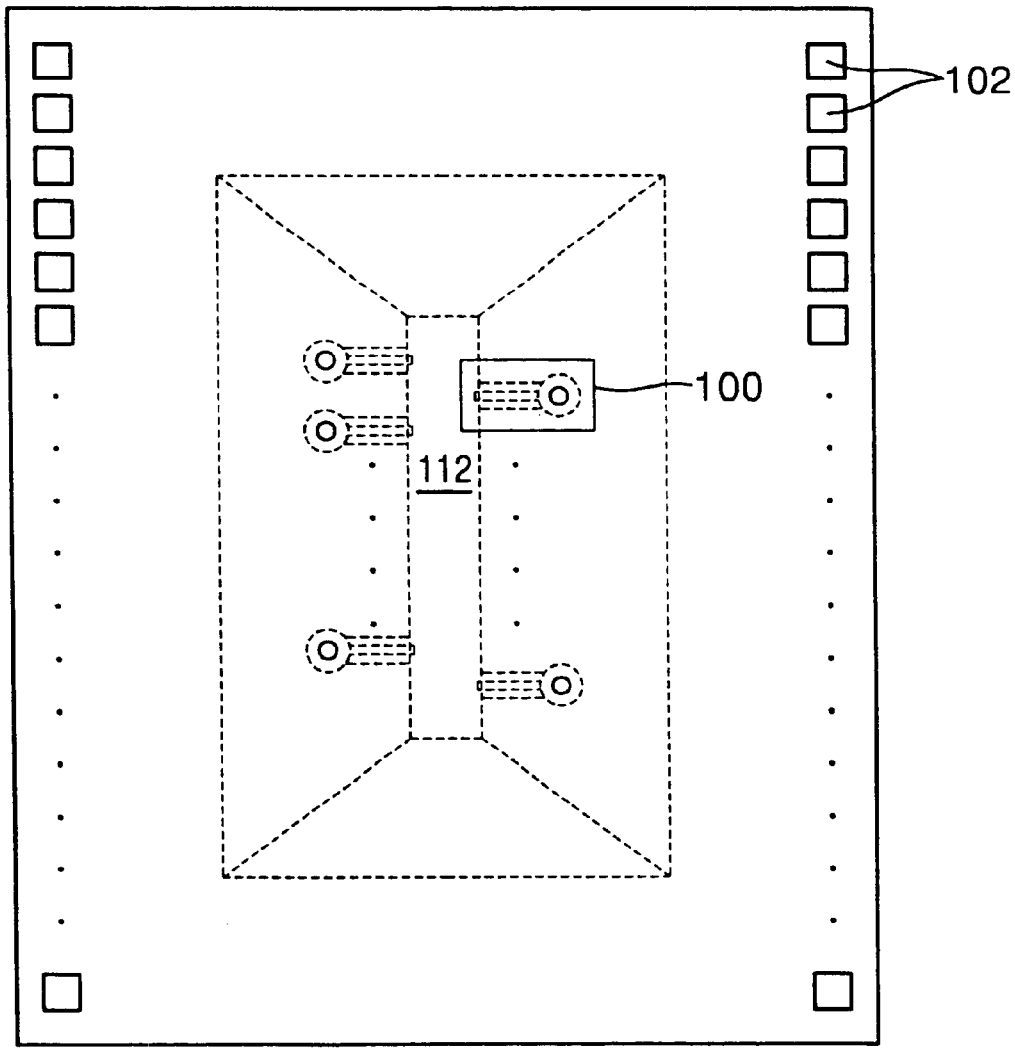
FIG. 2 illustrates a schematic plan view of an ink-jet printhead having a hemispherical chamber according to a first embodiment of the present invention.

FIG. 2 illustrates a schematic plan view of an ink-jet printhead according to a first embodiment of the present invention. Referring to FIG. 2, ink ejectors 100 are arranged in two rows in an alternating fashion on an ink supplying manifold 112 marked by dotted lines on the ink-jet printhead. Bonding pads 102, to which wires will be bonded, are arranged to be electrically connected to the ink ejectors 100. The manifold 112 is in flow communication with an ink container (not shown), which contains ink. In FIG. 2, the ink ejectors 100 are illustrated as being arranged in two rows, however, they may be arranged in a single row or three or more rows in order to increase resolution. In addition, the manifold 112 may be formed under each row of the ink ejectors 100. A printhead using only one color ink is illustrated in FIG. 2, however, three or four groups of ink ejectors may be arranged in order to print color images.

Figure 3:
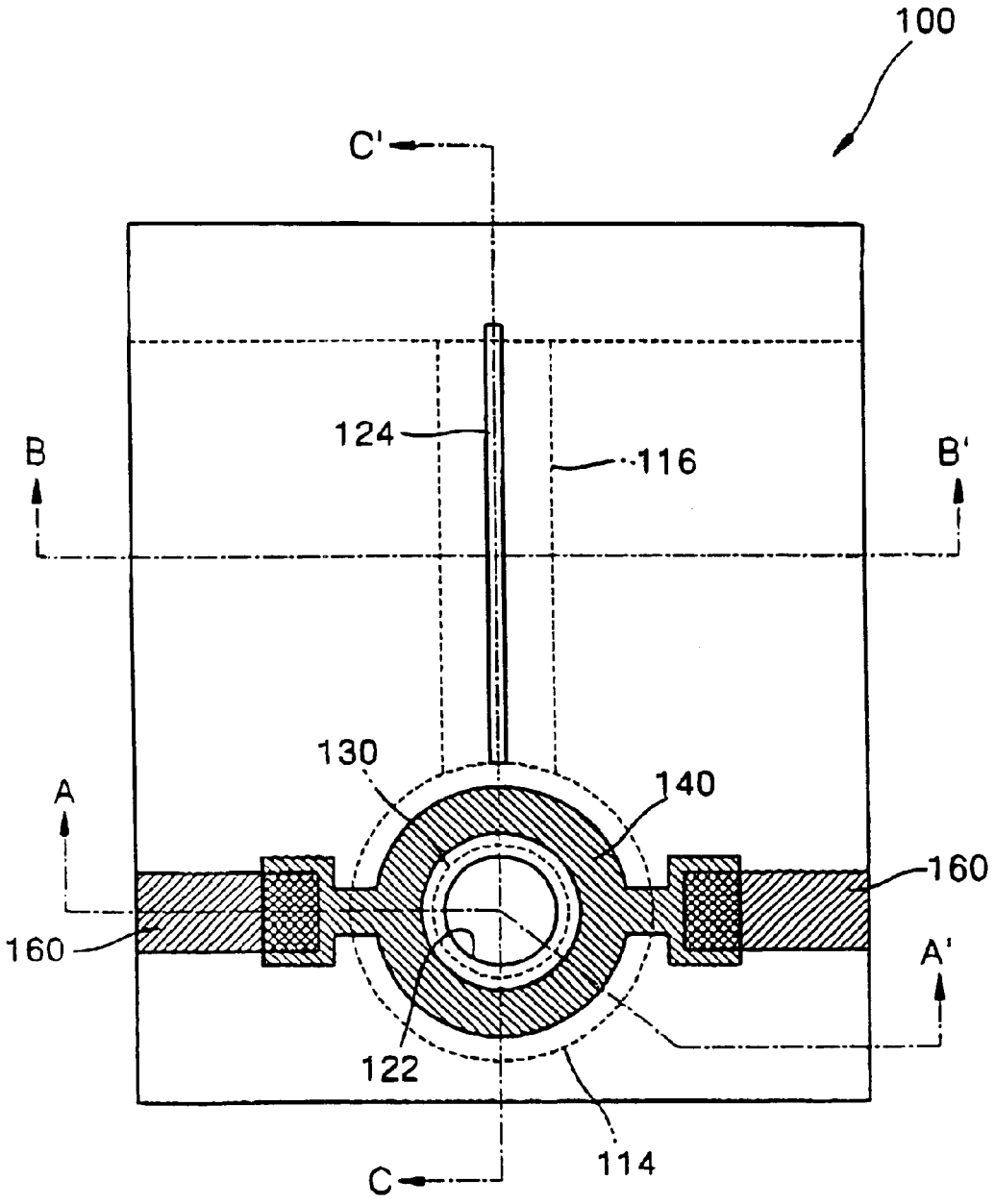
FIG. 3 illustrates an enlarged plan view of an ink ejector shown in FIG. 2.
Figure 4A:
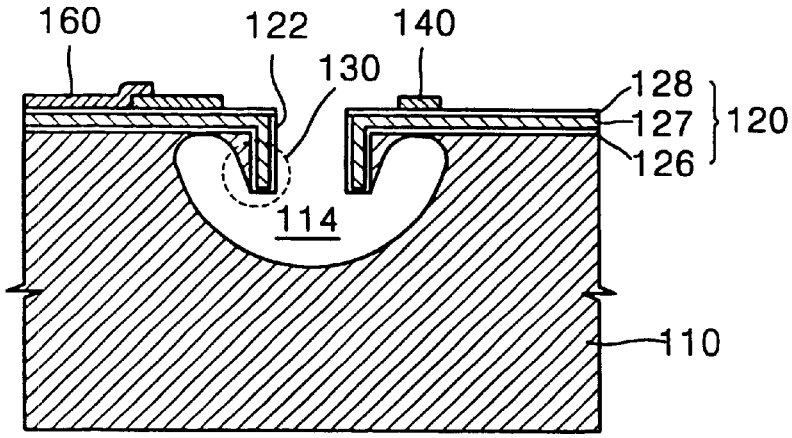
FIGS. 4A through 4C illustrate cross-sectional views showing the vertical structure of an ink ejector, taken along lines A–A', B–B', and C–C', respectively, of FIG. 3.
Figure 4B:
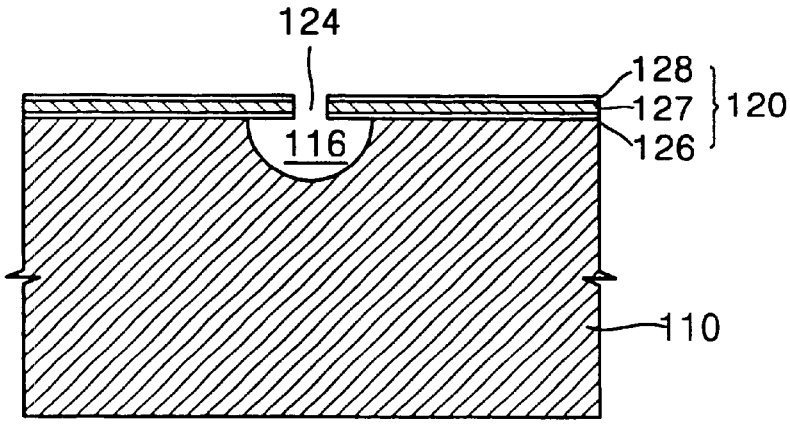
Figure 4C:
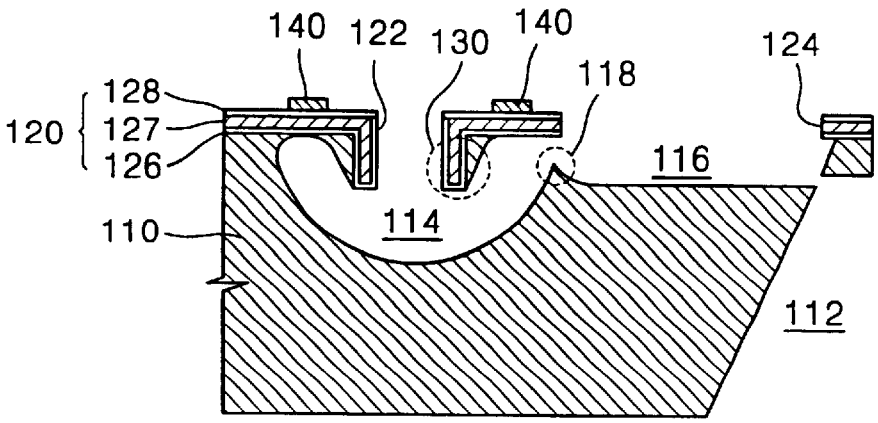

FIG. 3 illustrates an enlarged plan view of an ink ejector shown in FIG. 2. FIGS. 4A through 4C are cross-sectional views illustrating the vertical structure of the ink ejector, taken along lines A–A', B–B', and C–C', respectively, of FIG. 3.

Referring to FIGS. 3 and 4A through 4C, an ink chamber 114, which will be filled with ink, is formed to be substantially hemispherical in a substrate 110 in the ink ejector 100, and an ink channel 116, along which ink will be supplied to the ink chamber 114, is formed to be shallower than the ink chamber 114. The manifold 112 is formed under the ink channel 116 to meet one end of the ink channel 116 and to supply ink to the ink channel 116. In addition, a projection 118 for preventing expanded bubbles from bulging into the ink channel 116 is formed at the boundary between the ink chamber 114 and the ink channel 116.

A nozzle plate 120 having a structure, in which predetermined material layers are stacked, is formed on the surface of the substrate 110 to form an upper wall of the ink chamber 114. The nozzle plate 120 includes a first insulating layer 126, a thermally conductive layer 127, and a second insulating layer 128, which are sequentially stacked. In a case where the substrate 110 is formed of silicon, the first insulating layer 126 may be formed of a silicon oxide layer by oxidizing the surface of the substrate 110 or may be formed of a tetraethylorthosilicate (TEOS) oxide layer deposited on the substrate 110. The first insulating layer 126 is formed as thin as possible without losing the insulating characteristics of the first insulating layer. For example, the first insulating layer is formed to a thickness of about 500–2000 Å, preferably, to a thickness of 1000 Å. The thermally conductive layer 127 may be formed of a material having thermal conductivity higher than an oxide layer, for example, a polysilicon layer. The thermally conductive layer 127 is introduced to effectively dissipate heat generated in a heater 140, which will be described later. The thermally conductive layer 127 is formed to be thicker than the first insulating layer 126. For example, the thermally conductive layer 127 is formed to a thickness of between about 1–2 $\mu$m. The second insulating layer 128 may be formed of a TEOS oxide layer deposited on the thermally conductive layer 127. The second insulating layer 128 is formed to a thickness of between about 500–2000 Å, preferably, to a thickness of 1000 Å.

A nozzle 122 is formed at a location corresponding to a center of the ink chamber 114. A groove 124 for forming the ink channel 116 is formed to correspond to the ink channel 116.

A nozzle guide 130 is formed to extend from the edge of the nozzle 122 toward the interior of the ink chamber 114. The nozzle guide 130 may be comprised of the thermally conductive layer 127 and the first insulating layer 126, which extend to the inside of the ink channel 114. Accordingly, the nozzle guide 130 has a three-layered structure comprised of the thermally conductive layer 127, which extends to the interior of the ink chamber 114, and the first insulating layer 126, which is formed at the sidewalls of the thermally conductive layer 127. Since the nozzle guide 130 has a three-layered structure, it is strong enough to resist deformation due to high temperature and pressure variations in the ink chamber 114 caused by expansion of bubbles and ejection of ink droplets. The nozzle guide 130 guides the direction of ejection of ink droplets so that ink droplets may be precisely ejected in a direction perpendicular to the substrate 110. In addition, the nozzle guide 130 effectively dissipates heat generated in the ink chamber 114, which will be described in greater detail below.

A heater 140 for generating bubbles is formed in a ring shape on the nozzle plate 120, i.e., on the second insulating layer 128, to surround the nozzle 122. The heater 140 is formed of a resistive heating element, such as impurity-doped polysilicon. Electrodes 160, which are typically formed of a metal, are connected to the heater 140 for applying pulse current. The electrodes 160 are connected to the bonding pads (102 of FIG. 2).

Figure 5:
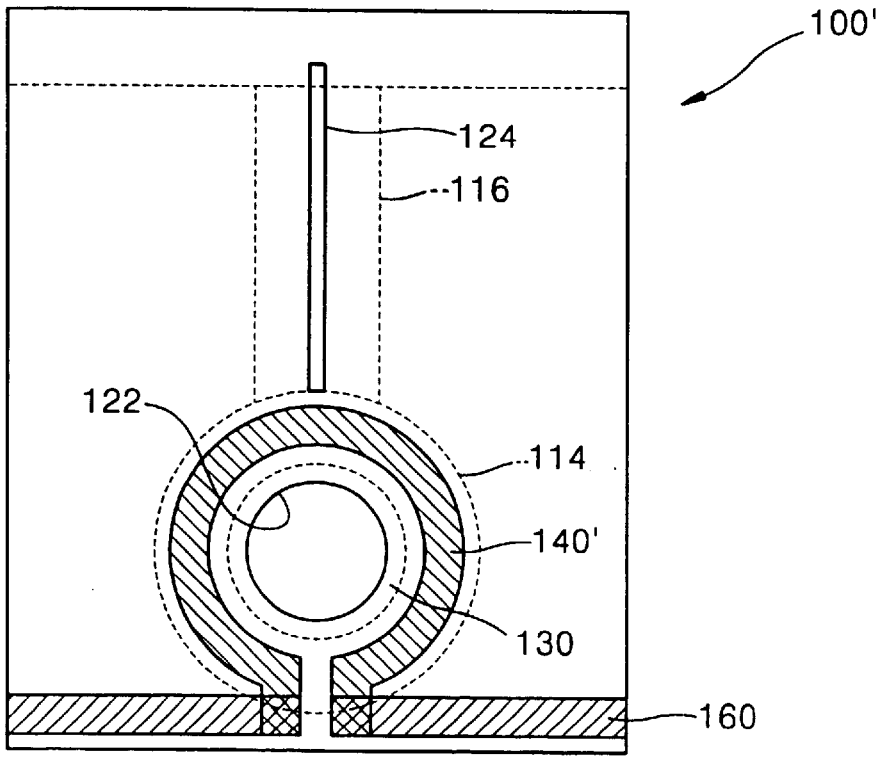
FIG. 5 illustrates a plan view of another example of the ink ejector shown in FIG. 3.

FIG. 5 illustrates a plan view showing another ink ejector. Referring to FIG. 5, a heater 140' of an ink ejector 100' is formed in the shape of the Greek letter omega, and electrodes 160 are connected to the both ends of the heater 140'. In other words, whereas the heater 140 shown in FIG. 3 is connected between the electrodes 160 in parallel, the heater 140' shown in FIG. 5 is connected between the electrodes 160 in series. The structure and arrangement of other components of the ink ejector 100' including a ink chamber 114, a ink channel 116, a nozzle plate, a nozzle 122, and a nozzle guide 130 are the same as the structure and arrangement of the corresponding elements of the ink ejector 100 illustrated in FIG. 3.

Figure 6:
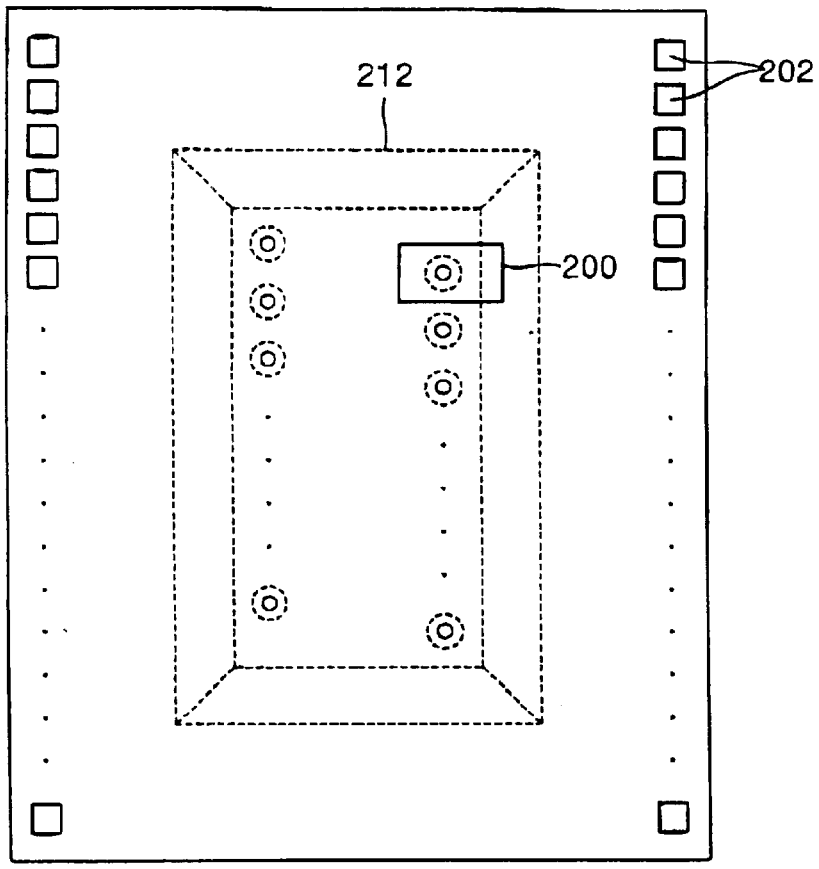
FIG. 6 illustrates a schematic plan view of an ink-jet printhead having a hemispherical chamber according to a second embodiment of the present invention.

FIG. 6 illustrates a schematic plan view of an ink-jet printhead according to a second embodiment of the present invention. Since the second embodiment of the present invention is similar to the first embodiment of the present invention, only differences between the first and second embodiments will now be described.

Referring to FIG. 6, ink ejectors 200 are arranged in two rows in an alternating fashion on an ink supplying manifold 212. Bonding pads 202, to which wires will be bonded, are arranged to be electrically connected to the ink ejectors 200.

Figure 7:
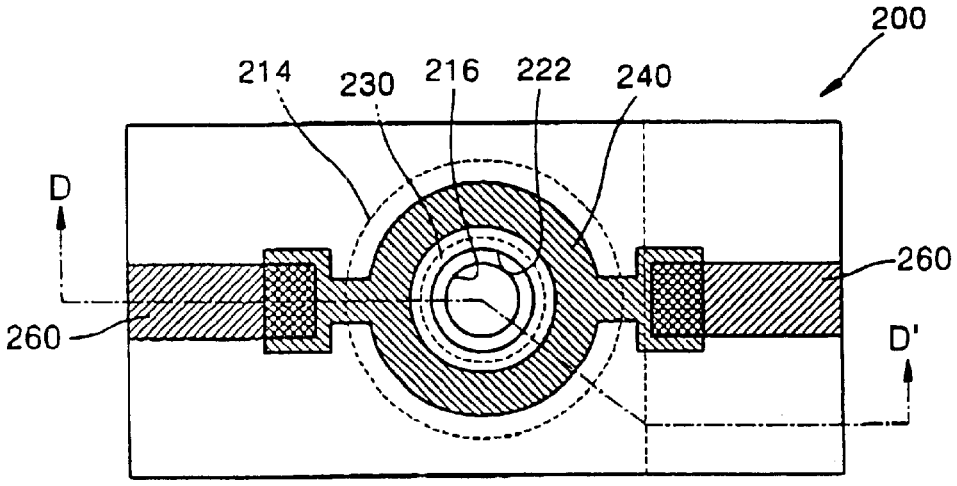
FIG. 7 illustrates a plan view of an ink ejector shown in FIG. 6.
Figure 8:
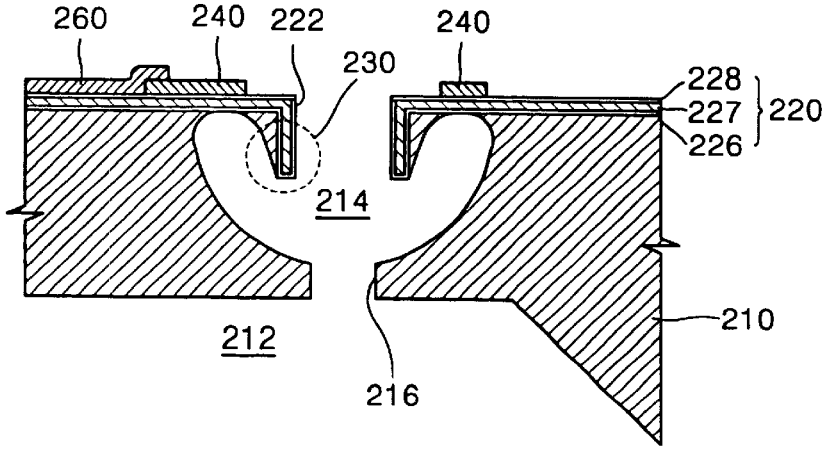
FIG. 8 illustrates a cross-sectional view showing the vertical structure of an ink ejector, taken along line D–D' of FIG. 7.

FIG. 7 illustrates an enlarged plan view of an ink ejector shown in FIG. 6. FIG. 8 illustrates a cross-sectional view showing the vertical structure of the ink ejector, taken along line D–D' of FIG. 7. Referring to FIGS. 7 and 8, the ink ejectors 200 have a similar structure to the ink ejectors 100 of the first embodiment, except for the shape and position of an ink channel 216 and the manifold 212. As shown in FIGS. 7 and 8, the ink chamber 214, which will be filled with ink, is formed to be hemispherical in a substrate 210 of the ink ejector 200. The manifold 212, which supplies ink to the ink chamber 214, is formed at the bottom of the substrate 210 under the ink chamber 214. The ink channel 216 is formed at the center of the bottom of the ink chamber 214 to connect the ink chamber 214 to the manifold 212 in flow communication. Since the diameter of the ink channel 216 affects an ink backflow phenomenon, in which ink bulges into the ink channel 116 and the speed at which ink is refilled after ejection, there is a need to control the diameter of the ink channel 216 precisely.

Other components of the ink ejector 200 including a nozzle plate 220 comprised of multi-layered material layers 226, 227, and 228, a nozzle 222, a nozzle guide 230, a heater 240, and electrodes 260 correspond to the similar elements of the ink ejector 100 of the first embodiment, and thus their descriptions will not be repeated here. The heater 240 is illustrated as being ring-shaped, however, the heater may be formed in the shape of the Greek letter omega.

Hereinafter, the ink ejection mechanism of an ink-jet printhead according to the present invention will be described with reference to FIGS. 9A and 9B. Here, the ink ejection mechanism and effects of the ink-jet printhead according to the first embodiment are almost the same as those of the ink-jet printhead according to the second embodiment of the present invention, and thus only the ink ejection mechanism of the ink-jet printhead according to the first embodiment of the present invention will be described here.

Figure 9A:
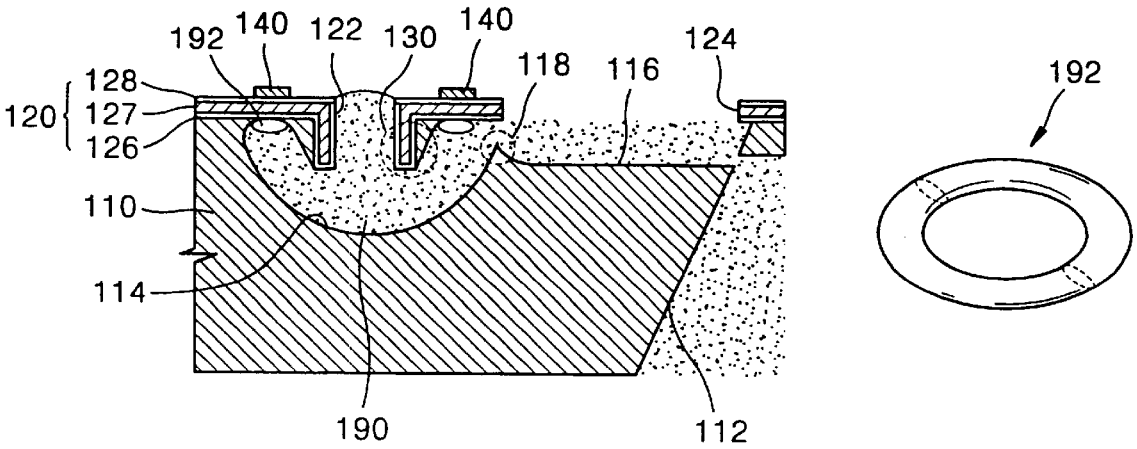
FIGS. 9A and 9B illustrate cross-sectional views of the ink ejection mechanism of an ink ejector illustrated in FIG. 3 taken along line C–C' of FIG. 3.
Figure 9B:
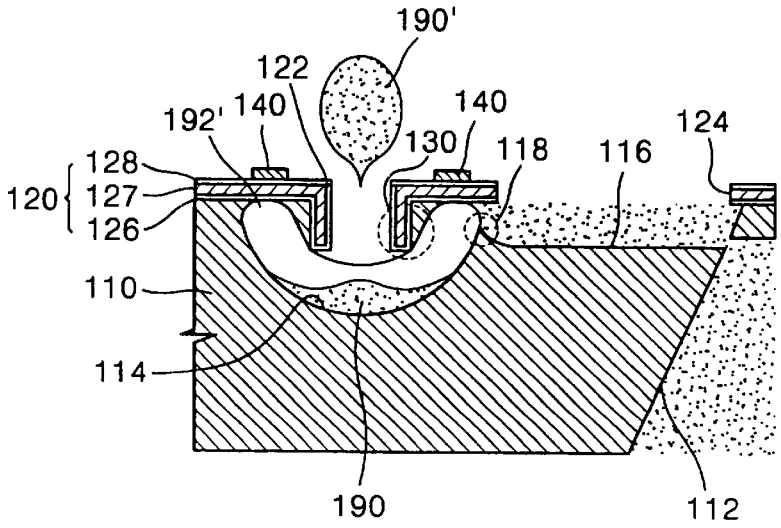

Referring to FIG. 9A, ink 190 is supplied to the ink chamber 114 via the manifold 112 and the ink channel 116 due to capillary action. If pulse current is applied to the heater 140 by the electrodes 160 in a state where the ink chamber 114 is filled with the ink 190, the heater 140 generates heat, and the heat is transmitted to the ink 190 via the nozzle plate 120 under the heater 140. Accordingly, the ink 190 begins to boil, and a bubble 192 is generated. The shape of the bubble 192 is formed to be almost the same as a doughnut in accordance with the shape of the heater 140, as illustrated to the right of FIG. 9A. Here, the heat generated by the heater 140 is easily transmitted via the nozzle plate 120 by the thermally conductive layer 127 having high thermal conductivity. In addition, since the two insulating layers 126 and 128, each of which have lower thermal conductivity, are formed to be very thin, the transmission of heat is only slightly impeded.

As time goes by, the doughnut-shaped bubble 192 continues to expand and changes into a disk-shaped bubble 192' having a slightly recessed upper center. At the same time, the direction of ejection of an ink droplet 190' is guided by the nozzle guide 130, and the ink droplet 190' is ejected from the ink chamber 114 via the nozzle 122 by the expanding bubble 192'. The disk-shaped bubble 192' may be easily formed by controlling the length of the nozzle guide 130 extending down.

If the current applied to the heater 140 is cut-off, the bubble 192' cools. Accordingly, the bubble 192' may begin to contract or burst, and the ink chamber 114 is refilled with ink 190 via the ink channel 116.

According to the ink ejection mechanism of the ink-jet printhead, as described above, if the tail of the ink droplet 190' to be ejected is cut by the doughnut-shaped bubble 192 transforming into the disk-shaped bubble 192', it is possible to prevent the occurrence of small satellite droplets.

In addition, since the heater 140 is formed in a ring shape or an omega shape, it has an enlarged area. Accordingly, the time taken to heat or cool the heater 140 may be reduced, and thus the time period from when the bubbles 192 and 192' first appear to their collapse may be shortened. Accordingly, the heater 140 may have a high response rate and a high driving frequency. In addition, the ink chamber 114 formed in a hemispherical shape has a more stable path for expansion of the bubbles 192 and 192' than a conventional ink chamber formed as a rectangular parallelepiped or a pyramid. Moreover, in the hemispherical ink chamber, bubbles are generated very quickly and quickly expand, and thus it is possible to eject ink within a shorter period of time.

In addition, since the expansion of the bubbles 192 and 192' is restricted within the ink chamber 114, and accordingly, the ink 190 is prevented from flowing backward, adjacent ink ejectors may be prevented from being affected by one another. Moreover, the ink channel 116 is formed shallower and smaller than the ink chamber 114, and the projection 118 is formed at the boundary between the ink chamber 114 and the ink channel 116. Thus, it is possible to effectively prevent the ink 190 and the bubble 192' from bulging into the ink channel 116. In a case where the diameter of the ink channel 216 is smaller than the diameter of the nozzle 222, as in the second embodiment of the present invention described with reference to FIGS. 6 through 8, it is similarly possible to effectively prevent backflow of ink.

The direction of ejection of the droplet 190' is guided by the nozzle guide 130 so that the droplet 190' may be precisely ejected in a direction perpendicular to the substrate 110. In a case where the nozzle guide 130 does not have sufficient strength, it may be easily deformed due to high temperature in the ink chamber 114 and pressure variations in the ink chamber 114 caused by the expansion of the bubbles 192 and 192' and the ejection of the ink droplet 190'. Thus, it is difficult to form the bubbles 192 and 192' in a desired shape and precisely eject the droplet 190' in a desired direction. However, according to the present invention, since the nozzle guide 130 is formed to have a multi-layered structure, as described above, the strength of the nozzle guide may be maintained at a sufficiently high level. Thus, the nozzle guide 130 is not easily deformed due to high temperature and pressure variations in the ink chamber 114.

In addition, since the thermally conductive layer 127 having high thermal conductivity is formed at the nozzle plate 120 and the nozzle guide 130, heat generated in the ink chamber 114 may be more quickly dissipated through the thermally conductive layer 127 when the current applied to the heater 140 is cut-off. Accordingly, the ink 190 quickly cools, and the bubble 192' quickly collapses. Thus, the driving frequency of the printhead may be increased.

A method for manufacturing an ink-jet printhead according to a first embodiment of the present invention will be described below. FIGS. 10 through 18 are cross-sectional views illustrating a method for manufacturing a printhead having the ink ejector illustrated in FIG. 3. Specifically, the left side of FIGS. 10 through 18 are cross-sectional views taken along line A–A' of FIG. 3, and the right side of FIGS. 10 through 18 are cross-sectional views taken along line C–C' of FIG. 3.

Figure 10:
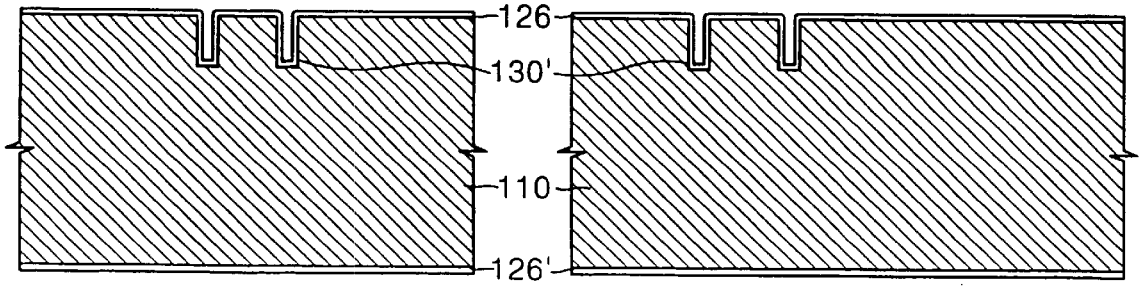
FIGS. 10 through 18 illustrate cross-sectional views showing a method for manufacturing a bubble-jet type ink-jet printhead including having an ink ejector illustrated in FIG. 3 according to a first embodiment of the present invention.

Referring to FIG. 10, a silicon wafer having a thickness of about 500 $\mu$m and having a crystal direction <100> is used as a substrate 110. This selection is because usage of a silicon wafer having been widely used in the manufacture of semiconductor devices contributes to the effective mass production of ink-jet printheads. A ring-shaped groove 130' having a depth of about 10 $\mu$m and a width of about 2 $\mu$m is formed at the surface of the substrate 110. The ring-shaped groove 130' is used to form a nozzle guide and its diameter is determined in consideration of the desired diameter of a nozzle to be formed later, for example, a diameter of 16–20 $\mu$m. The groove 130' may be formed by anisotropically etching the surface of the substrate 110 using a photoresist pattern as an etching mask.

Next, a first insulating layer 126 is formed at the surface of the silicon wafer 100. The first insulating layer 126 may be formed of a silicon oxide layer. Silicon oxide layers 126 and 126' are formed by wet-oxidizing or dry-oxidizing the top and bottom surfaces of the silicon wafer 110 in an oxidization furnace. Preferably, the first insulating layer 126 is formed as thin as possible without losing the insulating characteristics of the first insulating layer. For example, the first insulating layer 126 is formed to a thickness of between about 500–2000 Å, preferably, to a thickness of 1000 Å. The first insulating layer 126 may be replaced with a TEOS oxide layer deposited on the surface of the substrate 110.

Only a portion of a silicon wafer is illustrated in FIG. 10. Actually, the printhead according to the present invention is formed to include several tens through several hundreds of chips on a wafer. In addition, the silicon oxide layers 126 and 126' are illustrated as being formed at the top and bottom surfaces, respectively, of the substrate 110 because it is preferred that in the present embodiment, a batch oxidization furnace is used to oxide the substrate 110. However, in the case of using a sheet-fed oxidization furnace, in which only the top surface of the substrate 110 is exposed, only the top surface of the substrate 110 may be oxidized, and thus the silicon oxide layer 126' is not formed at the bottom surface of the substrate 110. All material layers shown in FIGS. 10 through 18 may be formed only at the top surface of the substrate 110 or at both the top and bottom surfaces of the substrate 110 according to types of apparatuses used to form the material layers. However, such material layers (a polysilicon layer, a silicon nitride layer, a TEOS oxide layer, and so on) will be described and illustrated as being formed only at the top surface of the substrate 110 for the convenience of description.

Figure 11:
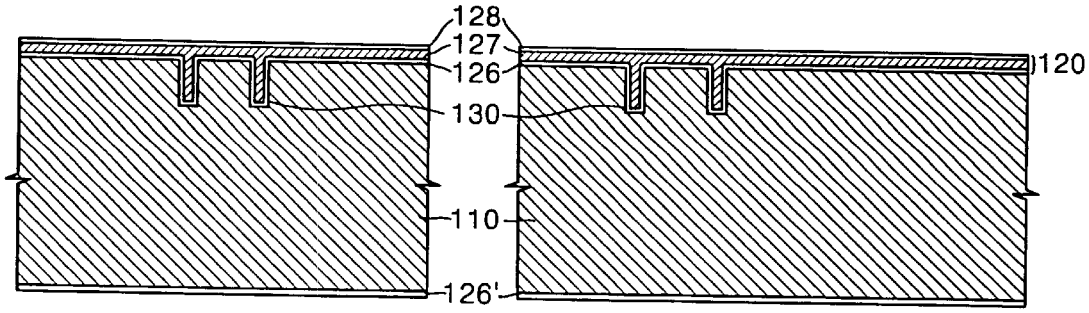

Referring to FIG. 11, a thermally conductive layer 127 and a second insulating layer 128 are sequentially deposited on the first insulating layer at the top surface of the substrate 110, thereby forming a nozzle plate 120 having a three-layered structure. The thermally conductive layer 127 may be formed of a polysilicon layer. The polysilicon layer may be deposited to a predetermined thickness, for example, a thickness of between about 1–2 $\mu$m, on the first insulating layer 126 by chemical vapor deposition (CVD). As a result of the deposition, the polysilicon layer is deposited in the ring-shaped groove 130'. Accordingly, the groove 130' is completely filled with the thermally conductive layer 127 and the first insulating layer surrounding the thermally conductive layer 127 to form a nozzle guide 130.

Next, a TEOS oxide layer is formed to a thickness of about 500–2000 Å, preferably, to a thickness of 1000 Å, on the thermally conductive layer 127 as the second insulating layer 128. Finally, a nozzle plate 120 having a structure, in which the first insulating layer 126, the thermally conductive layer 127, and the second insulating layer 128 are sequentially stacked, is formed.

Figure 12:
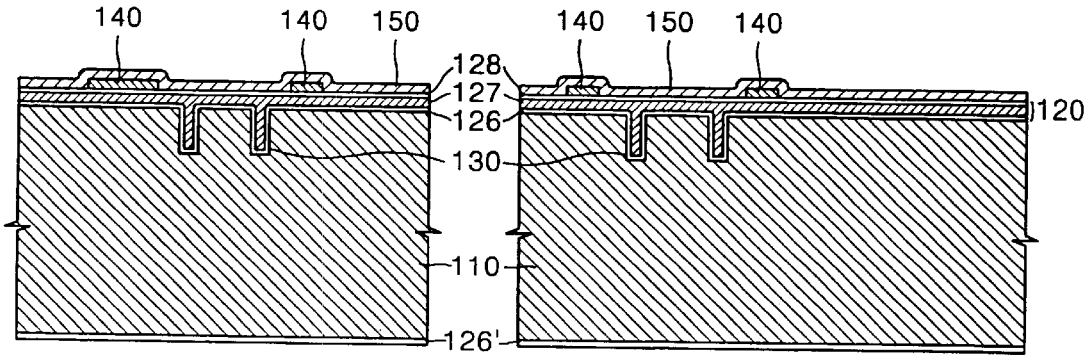

Referring to FIG. 12, a ring-shaped heater 140 and a silicon nitride layer 150 are formed on the nozzle plate 120. The heater 140 is formed by depositing impurity-doped polysilicon on the nozzle plate 120, i.e., on the second insulating layer 128, and patterning the polysilicon in a ring shape. Specifically, the impurity-doped polysilicon is deposited along with impurities, such as phosphorus source gas, on the second insulating layer 128 to a thickness of between about 0.7–1 $\mu$m by low pressure chemical vapor deposition (LPCVD). The thickness of the deposited polysilicon layer may be adjusted to have an appropriate resistance value in consideration of the width and length of the heater 140. The polysilicon layer deposited on the entire surface of the second insulating layer 128 is patterned by a photolithographic process using a photomask and photoresist and an etching process using a photoresist pattern as an etching mask. The silicon nitride layer 150 is a protection layer for the heater 140 and may be deposited to a thickness of about 0.5 $\mu$m by LPCVD.

Figure 13:
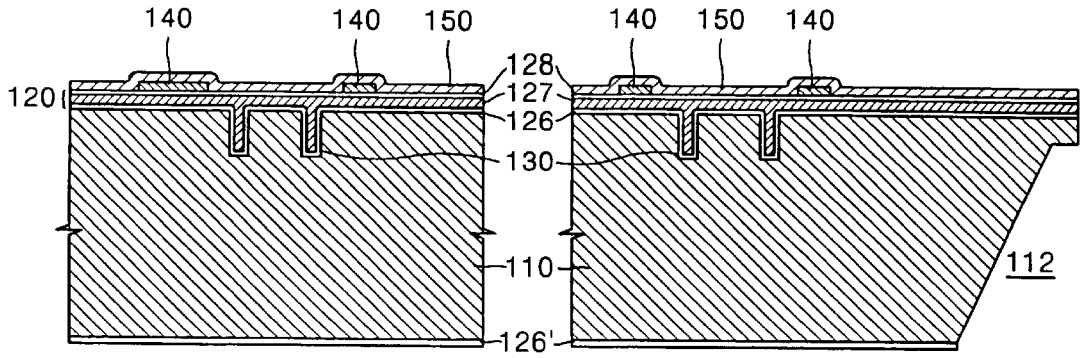

Referring to FIG. 13, a manifold 112 is formed by partially etching the bottom portion of the substrate 110 to be slanted. Specifically, an etching mask is formed to define a predetermined portion of the bottom surface of the substrate 110, and the bottom of the substrate 110 is wet-etched using tetramethylammoniumhydroxide (TMAH) as an etchant for a predetermined time. During the wet-etching, since the etching rate of the substrate 110 in a crystal orientation <111> is lower than the etching rate of the substrate 110 in other orientations, the manifold 112 is formed with an inclination angle of about 54.7°.

Alternatively, the manifold 112 may be formed before the manufacturing step described with reference to FIG. 13 or after a step of forming a TEOS oxide layer, (170 of FIG. 15) which will be described later. In addition, the manifold 112 is described above as being formed by inclination etching; however, it may be formed by anisotropic etching. Alternatively, the manifold 112 may be etched to perforate the substrate 110 or may be formed by etching not the bottom of the substrate 110 but rather the top surface of the substrate 110.

Figure 14:
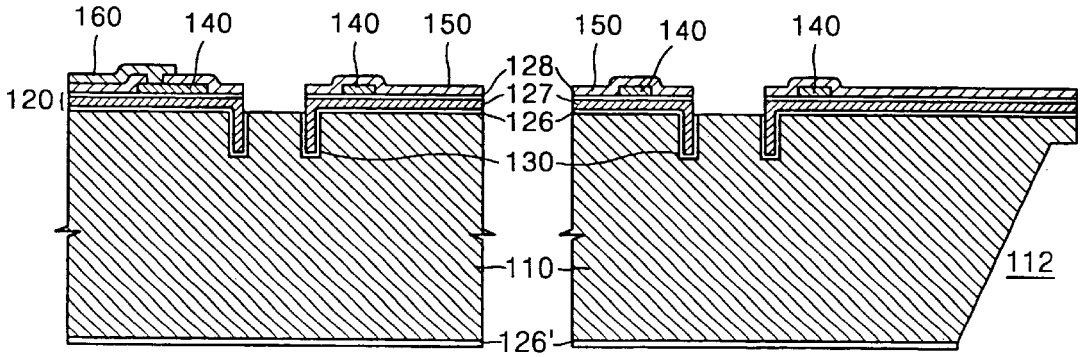

Referring to FIG. 14, an electrode 160 is formed, and then a predetermined portion of the substrate 110, at which a nozzle will be formed, is exposed. Specifically, a predetermined portion of the silicon nitride layer 150 on the heater 140 is etched to expose the predetermined portion of the heater 140, which will be connected to the electrode 160. Next, the electrode 160 is formed by depositing a metal which has high conductivity and is easily patterned, such as aluminium or an aluminium alloy, to a thickness of about 1 $\mu$m by sputtering and patterning the metal layer. At the same time, the metal layer is patterned to form wiring layers (not shown) and a bonding pad (102 of FIG. 2) in different regions. Next, portions of the silicon nitride layer 150 and the nozzle plate 120 corresponding to a nozzle to be formed are sequentially etched to expose the substrate 110.

Figure 15:
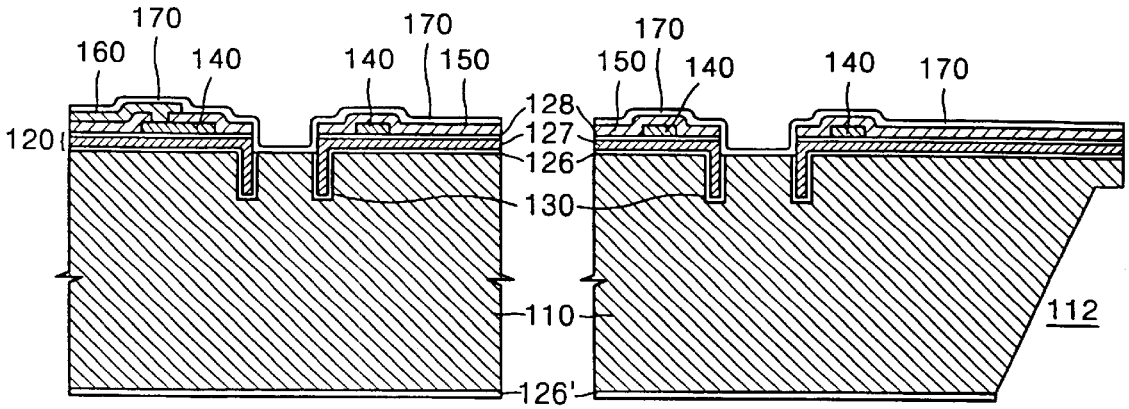

Referring to FIG. 15, a TEOS oxide layer 170 is formed on the entire surface of the substrate 110, on which the electrode 160 has been formed. The TEOS oxide layer 170 may be deposited at a low temperature within a range in which the electrode 160 formed of aluminium or an aluminium alloy and the bonding pad 102 of FIG. 2 are not deformed, for example, at 400° C. or below, by chemical vapor deposition (CVD). The TEOS oxide layer 170 is formed to partially cover the thermally conductive layer 127 exposed in the step described above with reference to FIG. 14.

Figure 16:
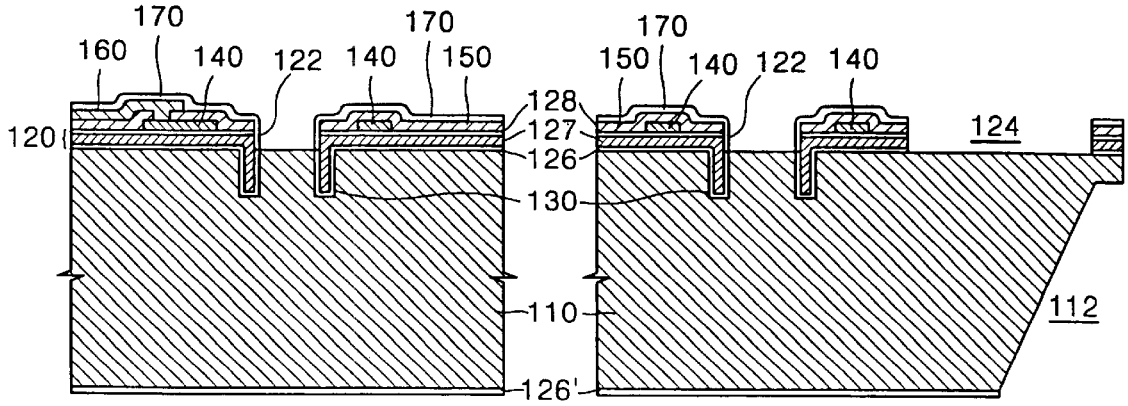

Referring to FIG. 16, a groove 124 for forming an ink channel is formed. Specifically, as shown in the right side of FIG. 16, the groove 124 is formed in a line shape outside the heater 140 to extend above the manifold 112. The groove 124 may be formed by sequentially etching the TEOS oxide layer 170, the silicon nitride layer 150, and the nozzle plate 120 to expose the substrate 110. The groove 124 is formed to have a length of about 50 $\mu$m and a width of about 2 $\mu$m. Here, the substrate 110 is exposed by etching the TEOS oxide layer 170 at the bottom of the nozzle 122. The groove 124 may be formed while exposing the predetermined portion of the substrate, at which the nozzle 122 will be formed, in the step described above with reference to FIG. 14, in which case the TEOS oxide layer 170 at the bottom of the groove 124 is removed in the step shown in FIG. 16. In addition, the groove 124 may be formed in a step shown in FIG. 17.

Figure 17:
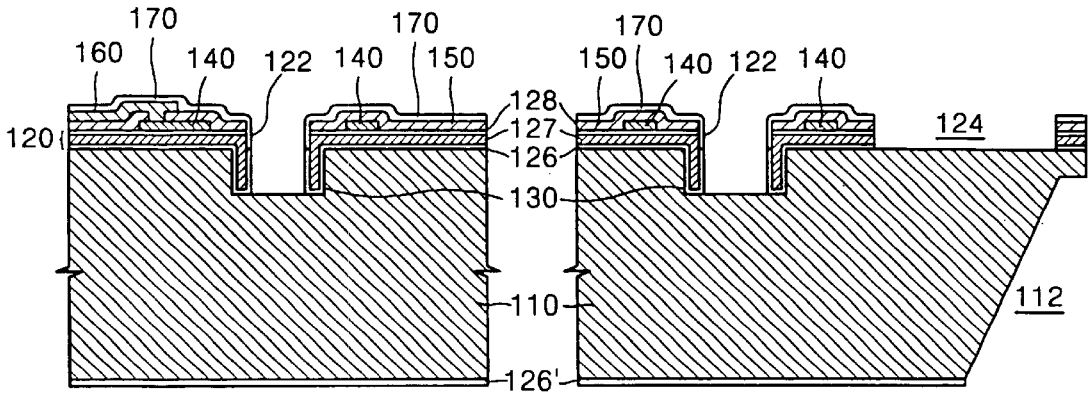

Next, as shown in FIG. 17, the predetermined portion of the substrate 110 exposed through the nozzle 122 is anisotropically etched so that the inner circumference of the nozzle guide 130 may be completely exposed.

Figure 18:
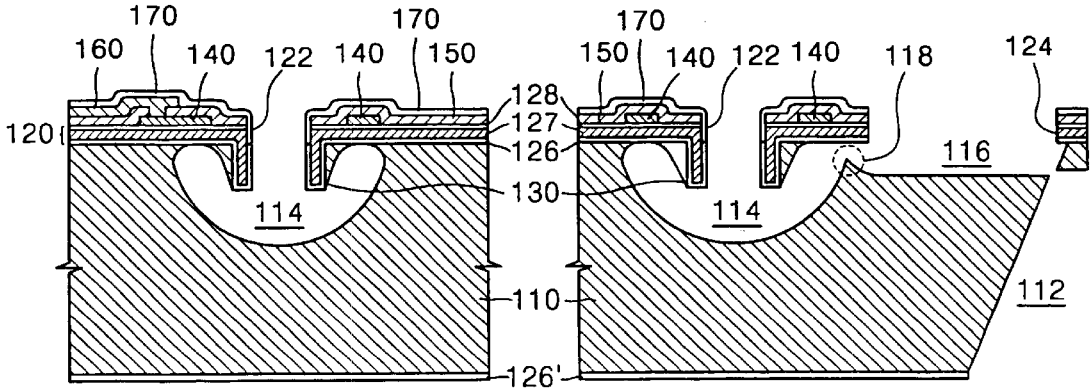

As shown in FIG. 18, the exposed potions of the substrate 110 are etched, thereby forming an ink chamber 114 and an ink channel 116. The ink chamber 114 may be formed by isotropically etching the substrate 110 exposed through the nozzle 122. Specifically, the substrate 110 is dry-etched for a predetermined time using $XeF_2$ gas or $BrF_3$ gas as an etching gas. As a result of the dry etching, the ink chamber 114 is formed to be a substantially hemispherical shape with a depth and a diameter of about 20 $\mu$m, and simultaneously, the ink channel 116 is formed to connect the ink chamber 114 and the manifold 112 and have a depth and a diameter of between about 8–12 $\mu$m. In addition, a projection 118 for preventing bubbles generated in the ink chamber 114 from bulging into the ink channel 116 is formed along the boundary between the ink chamber 114 and the ink channel 116. The ink chamber 114 and the ink channel 116 may be formed at the same time or may be sequentially formed.

Figure 19:
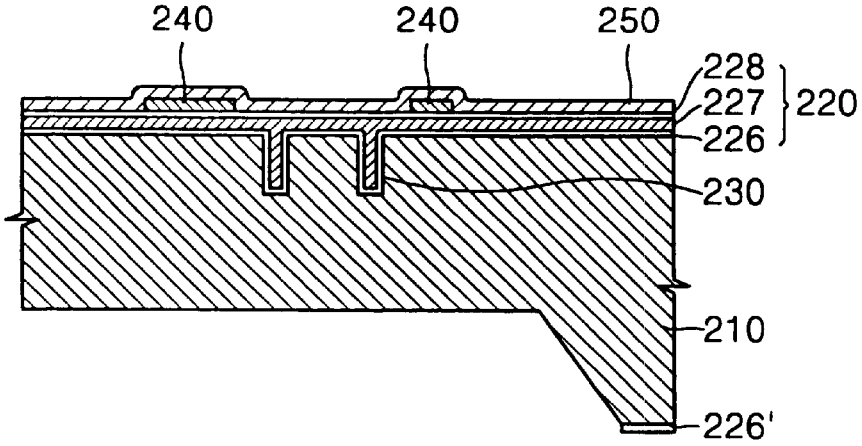
FIGS. 19 and 20 illustrate cross-sectional views showing a method for manufacturing a bubble-jet type ink-jet printhead having an ink ejector illustrated in FIG. 7 according to a second embodiment of the present invention.
Figure 20:
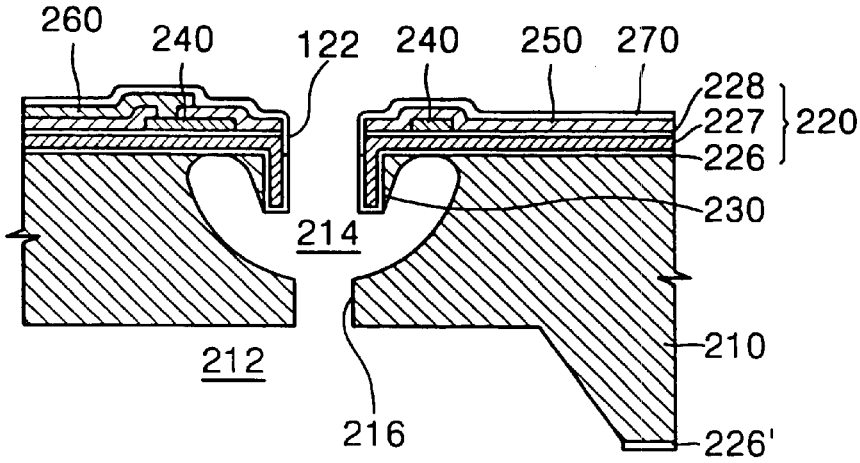

FIGS. 19 and 20 are cross-sectional views illustrating a method for manufacturing an ink-jet printhead having an ink ejector illustrated in FIG. 7 according to a second embodiment of the present invention, taken along line D–D' of FIG. 7.

The method for manufacturing an ink-jet printhead according to the second embodiment of the present invention is the same as the method for manufacturing an ink-jet printhead according to the first embodiment of the present invention, except in the formation of a manifold and an ink channel.

In other words, the process described above with reference to FIGS. 11 and 12 is the same as the corresponding process of the second embodiment of the present invention. However, in the second embodiment, unlike in the first embodiment, a manifold is formed under an ink chamber to be formed later by etching the bottom portion of a substrate 210, as shown in FIG. 19.

The process described above with reference to FIGS. 14 through 18 is the same as the corresponding process of the second embodiment. However, in the second embodiment, unlike in the first embodiment, the ink channel shown in the right side of FIGS. 14 through 18 is not formed. Instead of forming the ink channel in the second embodiment, an ink channel 216 is formed to be in flow communication with the manifold 212 by anisotropically etching the middle portion of the bottom of the ink chamber 214 after forming an ink chamber 214, as shown in FIG. 20. Then, the ink-jet printhead according to the second embodiment of the present invention is completed.

As described above, the ink-jet printhead having a hemispherical chamber of the present invention and the method for manufacturing the same produces the following effects.

First, since a heater is formed in a ring shape and an ink chamber is formed in a hemispherical shape, it is possible to prevent backflow of ink and cross-talk among adjacent ink ejectors. In addition, it is possible to prevent the occurrence of satellite droplets.

Second, since the direction of ejection of droplets is guided by a nozzle guide, it is possible to precisely eject droplets in a direction perpendicular to a substrate. In addition, since the nozzle guide is formed to have a multi-layered structure and to sufficiently maintain high strength, the nozzle guide may be prevented from being deformed irrespective of high temperature and pressure variations in an ink chamber.

Third, since a thermally conductive layer having high thermal conductivity is formed at a nozzle plate and the nozzle guide, it is possible to more quickly dissipate heat generated in the ink chamber through the thermally conductive layer. Thus, ink may quickly cool, and bubbles may quickly collapse. Accordingly, the period of time from when bubbles first appear to their collapse may be shortened, thus increasing the driving frequency of the printhead.

Fourth, since elements of a printhead including a substrate, in which a manifold, an ink chamber, and an ink channel are formed, a nozzle, a nozzle guide, and a heater are integrally formed into one body, the inconvenience of the prior art, in which a nozzle plate, an ink chamber, and an ink channel are separately manufactured and then are bonded to one another, and the problem of misalignment may be overcome. In addition, typical processes for manufacturing semiconductor devices may be directly applied to the manufacture of a bubble-jet type ink-jet printhead according to the present invention, and thus mass production of the printhead may be facilitated.

While the present invention has been particularly shown and described with reference to preferred embodiments thereof, it will be understood by those of ordinary skill in the art that various changes in form and details may be made therein without departing from the spirit and scope of the invention as defined by the appended claims. For example, the elements of the printhead according to the present invention may be formed of different materials, which are not mentioned in the specification. A substrate may be formed of a material which is easy to process, instead of silicon, and a heater, an electrode, a silicon oxide layer, and a nitride layer may be formed from different materials. In addition, the methods for depositing materials and forming elements suggested above are just examples. Various deposition methods and etching methods may be employed within the scope of the present invention.

Also, the order of processing steps in the method for manufacturing a printhead according to the present invention may vary. Finally, numerical values presented herein may be freely adjusted within a range in which a printhead can operate normally.

What is claimed is:

1. A method for manufacturing an ink-jet printhead having a hemispherical chamber, comprising:

forming a ring-shaped groove for forming a nozzle guide at a surface of a substrate;

forming a nozzle plate and a nozzle guide having a multi-layered structure and including a thermally conductive layer formed at the surface of the substrate;

forming a heater having an interior diameter and an exterior diameter on the nozzle plate;

forming a manifold for supplying ink by etching the substrate;

forming an electrode on the nozzle plate to be electrically connected to the heater;

forming a nozzle by etching the nozzle plate within the interior diameter of the heater to have a diameter nearly equal to the diameter of the nozzle guide;

forming an ink chamber in a substantially hemispherical shape by etching the substrate exposed through the nozzle; and forming an ink channel for supplying ink from the manifold to the ink chamber by etching the substrate.

2. The method as claimed in claim 1, wherein forming the nozzle plate and the nozzle guide comprises:

forming a first insulating layer at the surface of the substrate and inner surfaces of the ring-shaped groove;

forming the thermally conductive layer by depositing polysilicon on the first insulating layer and simultaneously forming the nozzle guide by filling the polysilicon in the ring-shaped groove; and forming a second insulating layer on the thermally conductive layer.

3. The method of claim 2, wherein the first and second insulating layers are formed to a thickness of between about 500–2000 Å, and the thermally conductive layer is formed to a thickness of between about 1–2 $\mu$m.

4. The method as claimed in claim 1, wherein the ink channel is formed to be in flow communication with the manifold by anisotropically etching the substrate at the bottom of the ink chamber to have a predetermined diameter.

5. The method as claimed in claim 1, wherein forming the ink channel comprises:

forming a groove for forming the ink channel, through which the substrate is exposed, by etching the nozzle plate beyond the exterior diameter of the heater and the manifold; and isotropically etching the substrate exposed through the groove.

* * * * *